US005687650A

United States Patent [19]

Murphy et al.

[11] Patent Number: 5,687,650

[45] Date of Patent: Nov. 18, 1997

[54] GAP CLOSING DEVICE FOR CLOSING GAPS IN AUTO RACK CAR SIDE WALLS

[75] Inventors: Richard F. Murphy, Batavia; Michael K. Burke, Wheaton, both of Ill.

[73] Assignee: Zeftek, Inc., Montgomery, Ill.

[21] Appl. No.: 633,591

[22] Filed: Apr. 17, 1996

[51] Int. Cl.[6] ..... B61D 45/00

[52] U.S. Cl. ..... 105/355; 105/374; 105/404; 52/718.05

[58] Field of Search ..... 105/355, 374, 105/378, 392.5, 404, 424; 52/288, 716.1, 716.4, 717.01, 718.05, 718.02; 411/44.5, 49, 47, 57, 508; 403/363, 397; 293/128; 24/453, 662; 410/4, 66; 267/140

[56] References Cited

U.S. PATENT DOCUMENTS

| | | | |
|---|---|---|---|
| 2,846,959 | 8/1958 | Perry | 105/374 |
| 3,807,318 | 4/1974 | Chierici | 105/299 |
| 3,861,110 | 1/1975 | Bartlett | 52/718.05 |
| 3,865,358 | 2/1975 | Butters | 293/128 |
| 4,405,272 | 9/1983 | Wollar | 411/45 |
| 4,489,465 | 12/1984 | Lemkin | 411/508 |
| 4,555,885 | 12/1985 | Raymond et al. | 52/468 |
| 4,913,061 | 4/1990 | Youngblood | 105/355 |
| 4,946,727 | 8/1990 | Kessler | 52/718.05 |
| 4,964,347 | 10/1990 | Long et al. | 105/355 |
| 4,974,900 | 12/1990 | Destefani et al. | 105/397 |
| 5,014,934 | 5/1991 | McClaflin | 52/718.05 |
| 5,085,545 | 2/1992 | Takahashi | 411/45 |
| 5,096,753 | 3/1992 | McCue et al. | 293/128 |
| 5,239,933 | 8/1993 | Murphy et al. | 105/374 |
| 5,311,823 | 5/1994 | Rudibaugh et al. | 105/355 |
| 5,415,108 | 5/1995 | Murphy et al. | 105/374 |
| 5,579,697 | 12/1996 | Burke | 105/355 |

OTHER PUBLICATIONS

Thrall Mfg. Co., photograph of gap–sealing device, May 18, 1995 (1 page).

*Primary Examiner*—S. Joseph Morano
*Attorney, Agent, or Firm*—Lloyd L. Zickert; Adam H. Masia

[57] ABSTRACT

A gap closing device for closing the air gaps between the sidewall panels and the floor and/or the gaps between the sidewall panels and auxiliary floor panels or plates in an auto rack railroad car comprising an elongated strip of flexible extruded plastic material having a spine adapted to extend through the gap, a flap centrally connected to one end of the spine for closing the gap, and fins extending from the spine to lock the device in gap closing position. The fins may include a plurality of locking and/or pressure fins.

17 Claims, 5 Drawing Sheets

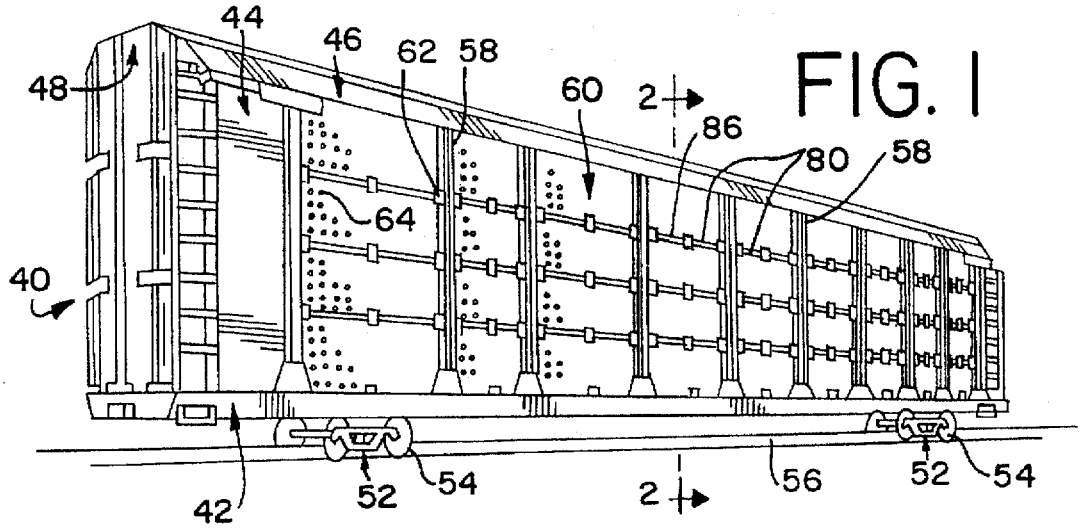
FIG. 1
FIG. 2
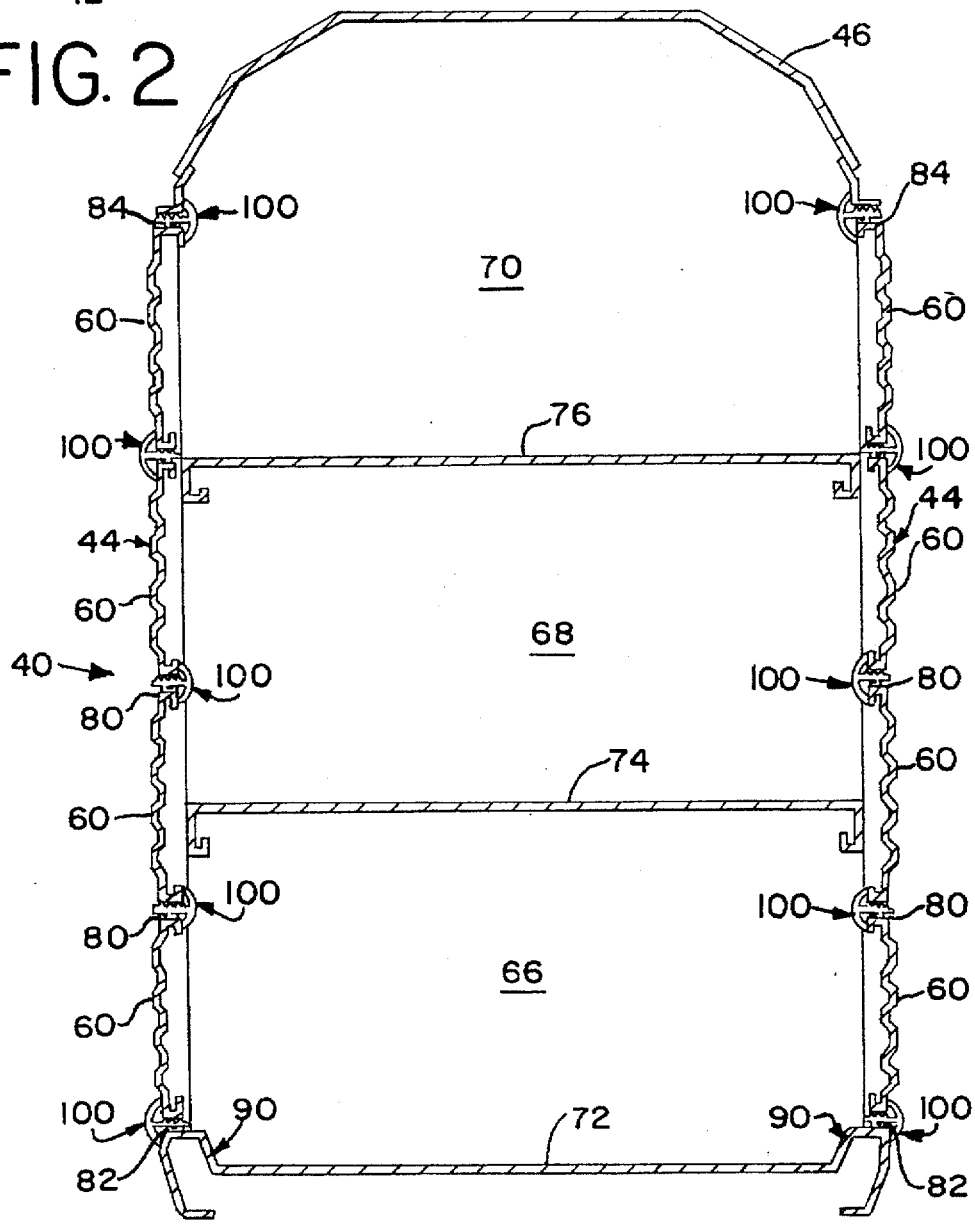

GAP CLOSING DEVICE FOR CLOSING GAPS IN AUTO RACK CAR SIDE WALLS

This invention relates in general to a gap closing device for closing air gaps in auto rack railroad cars to protect the vehicles being transported from being damaged by air-carried contaminants, and more particularly to a gap closing device for closing the air gaps between the sidewall panels and the floor, between the sidewall panels and auxiliary floor panels or plates, between adjacent sidewall panels, and between splash pans and the floor or deck in an auto rack railroad car.

BACKGROUND OF THE INVENTION

Heretofore, it has been common practice to transport newly manufactured vehicles, such as automobiles, vans, and trucks, made in this country or imported into this country on auto rack equipped railroad cars. The transportation of newly manufactured vehicles by railroad is usually over long distances above three hundred miles. For example, domestic vehicles manufactured in the mid-west are transported to the west coast, or in another example, imported vehicles manufactured abroad which arrive on the west coast are transported to midwestern cities. A train having auto rack equipped railroad cars, known in the industry as auto rack cars, can take several days to reach its destination while traveling over thousands of miles through varying terrain. These trains also travel throughout the year enduring the severest of winter and summer weather as well as other environmental and man-made conditions.

The typical auto rack car is compartmented, having a floor and one or two decks above the floor, opposed side walls, doors in front and back or at each end, and a roof. The side walls are constructed of numerous sidewall panels made of galvanized steel which are vertically arranged and attached between vertical posts that are spaced evenly throughout the length of the auto rack car. These sidewall panels are installed with horizontally extending air gaps or openings between vertically adjacent panels, between the panels and the floor, between auxiliary panels or plates and the floor, between splash pans and the floor or deck, and between the sidewall panels and the roof. The cars are also constructed with vertically extending air gaps or openings between the sidewall panels and the vertical posts. The construction of these cars varies, especially where the sidewalls meet the floor, which is generally an area accessible to a person standing on the ground next to the auto rack car.

The gaps permit the entry of air into the auto rack car and thus onto the newly manufactured vehicles being stored in transit. As is readily appreciated, the lowermost gaps, such as the gaps between the sidewall panels and the floor, permit entry of a significant amount of contaminated air into the auto rack car, including contaminants kicked up from the tracks by the movement of the train. This rapidly moving air entering the auto rack car carries contaminants such as iron oxide, smoke or exhaust from the railroad engine, metal filings or shavings from the railroad tracks, dirt or sand carrying chemicals such as fertilizer, acid rain, and other precipitation-containing contaminants, all of which can damage the finishes of the newly manufactured vehicles. This damage can be so extensive that the manufacturer has to repaint or refinish the vehicles. To solve this problem, the auto industry has gone as far as placing protective plastic sheets or wrappings on parts of the vehicles prior to shipment.

Devices for closing the gaps on the auto rack cars have also been developed such as those disclosed in U.S. Pat. Nos. 5,239,933; 5,311,823, and 5,415,108. It has been found that these devices do not completely solve the problem of incoming air containing contaminants, especially through the lowermost or floor gaps. This is due in part to the inordinate number of styles of the auto rack cars including the use of different shaped flanges, auxiliary panels, auxiliary plates, and splash pans adjacent to the floor.

SUMMARY OF THE INVENTION

The present invention overcomes the above contamination problem in providing a gap closing device for closing floor gaps. The present invention may also be used to close the gaps between adjacent sidewall panels, the sidewall panels and the roof, and the sidewall panels and the vertical posts. By closing these gaps, the inside of the auto rack car is protected against entry through the closed gaps of high-velocity air which carries damaging contaminants.

The first embodiment of the present invention is easily installed from the outside of the auto rack car by a person standing on the ground outside the car. The floor gap closing device includes an elongated strip of flexible extruded plastic, such as vinyl or other suitable material, in a preformed shape. The shaped device has an elongated spine adapted to extend through the gap and a flap centrally connected to one end of the spine which is disposed preferably at the outside of the car and adapted to close the gap between the sidewall panel and the floor. The spine has at least one, but preferably several, spaced-apart locking fins extending from the top side or surface of the spine which are adapted to securely engage the flange of the sidewall panel. The spine may also include at least one pressure fin extending from the bottom side or surface of the spine opposite the locking fins and is adapted to engage the floor of the car to maintain the locking fins in locking engagement with the flange.

The gap closing device is installed preferably by a person standing on the ground who inserts the end of the spine opposite the closing flap into the floor gap. When installed, the locking fins securely engage the flange of the sidewall panel and the pressure fins engage the floor of the auto rack car to maintain the locking fins in locking position against the flange. The closing flap spans the vertical height of the gap and engages the outer walls of the sidewall panel and the floor, thereby closing the gap and preventing air and contaminants from entering the auto rack car through the gap.

The gap closing device may be used to close the gap between varying sidewall panels and the floor, between sidewall panels and an auxiliary floor panel, between the auxiliary floor panels and the floor, and between sidewall panels and floor plates. The gap closing device of the present invention, or an alternative embodiment in which the body includes a plurality of locking fins extending from each side of the spine, can be further used to close gaps between adjacent sidewall panels, between sidewall panels and the roof, and between sidewall panels and vertical posts.

A further embodiment of the gap closing device of the present invention is adapted to close the gap on cars having a splash pan and a flush deck arrangement. This gap closing device includes a spine, a closing flap at one end of the spine, and a hinged locking bar at the opposite end of the spine having a fin for engaging the inside surface of the splash pan. A U-shaped spring clip is provided to overlie the hinge, the spine, and the leg to lock the fin against the splash pan.

A still further embodiment of the gap closing device of the present invention is also adapted to close the gap on cars having a splash pan and a flush deck structure. The gap closing device includes a spine, a closure flap at one end of the spine engaging the outer surfaces of the pan and deck for closing the gap, a locking fin extending upwardly from the top side or surface of the spine for engaging the inside surface of the splash pan, and a pressure fin extending downwardly from the bottom side or surface of the spine for engaging the deck.

It is therefore an object of the present invention to provide a gap closing device which closes the horizontally extending gaps between the sidewall panels and the floor on an auto rack car, thereby preventing air-carried contaminants from damaging the finishes of newly manufactured vehicles being transported in auto rack cars.

Another object of the present invention is to provide a gap closing device for closing the variety of floor gaps in an auto rack car which may be easily installed from the outside of the auto rack car by a person standing on the ground next to the car which ultimately reduces overall installation time and increases safety.

Another object of the present invention is to provide a gap closing device for closing gaps between adjacent sidewall panels, between sidewall panels and the roof, and/or between sidewall panels and the vertical posts.

Other objects, features and advantages of the invention will be apparent from the following detailed disclosure, taken in conjunction with the accompanying sheets of drawings, wherein like reference numerals refer to like parts.

DESCRIPTION OF THE DRAWINGS

FIG. 1 is a perspective view of a typical auto rack car having a series of vertical posts on each side wall and four sidewall panels horizontally extending and vertically mounted between each pair of adjacent vertical posts;

FIG. 2 is a cross-sectional view of the tri-level auto rack car taken substantially along line 2—2 in FIG. 1 showing the placement of the gap closing device of the present invention;

FIGS. 13, 14 and 15 are side elevational views showing the sequential steps for installing the gap closing device of the embodiment of FIGS. 11 and 12, wherein FIG. 13 illustrates the device as being open so that the spine and fin means can be inserted through the gap;

FIG. 14 shows the folding of the fin means into locking position;

FIG. 15 shows the U-shaped locking clip in place to hold the fin in locking position;

DESCRIPTION OF THE INVENTION

Figure 3:
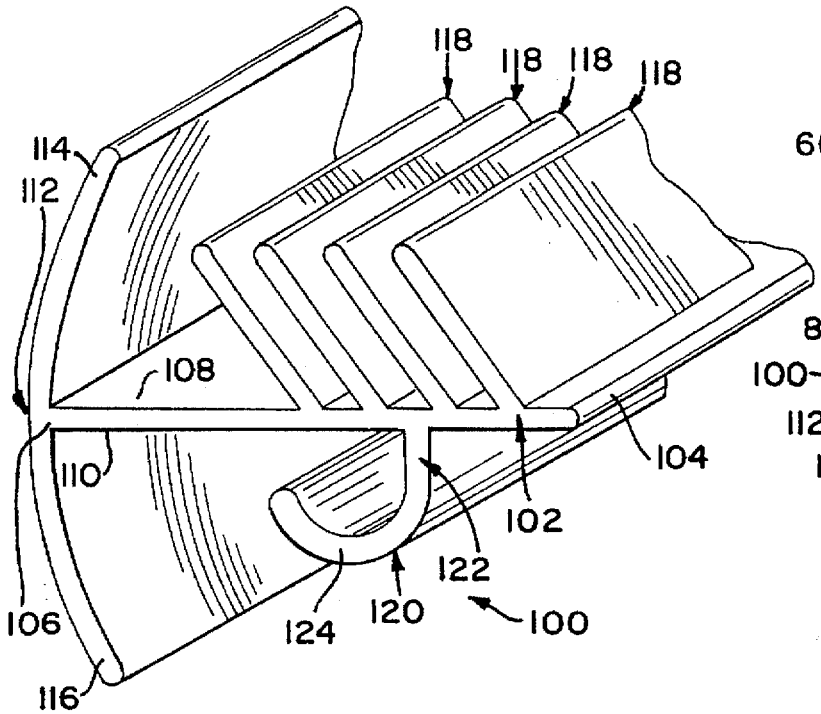
FIG. 3 is an enlarged fragmentary perspective view of the gap closing device of the present invention illustrating the spine, the closing flap, the locking fins, and the pressure fin.

The gap closing device of the present invention solves the problem of damage to the finishes of newly manufactured vehicles being transported in auto rack cars by significantly reducing the flow of air-carried contaminants into the auto rack car and across the vehicles. The gap closing device of the present invention includes an elongated strip of flexible extruded plastic which is inserted into the gaps between the sidewall panels and the floor to close the gaps and thereby prevent contaminant-laden air from entering the gap.

Referring now to the drawings, and particularly to FIGS. 1 and 2, a typical auto rack car 40 includes a frame 42 which supports two side walls 44 and a roof 46. At each end of the auto rack car 40 are two pairs of doors 48. These doors 48 are opened during the loading and unloading of vehicles (not shown). The frame 42 is supported on trucks 52, each of which have several wheels 54 which roll along railroad tracks 56.

The side walls 44 include a series of steel vertical posts 58 which are mounted on and extend upwardly from the frame 42. The roof 46 is mounted on and supported by these vertical posts 58. Vertical posts 58 extend between the frame and the roof and are spaced along the entire length of both sides walls 44 of the auto rack car. A plurality of rectangular galvanized steel sidewall panels 60 extend horizontally and are vertically spaced apart between each pair of vertical posts 58. It will be appreciated the panels may be made of other materials. These sidewall panels 50 are supported at their corners by metal brackets 62 that are suitably secured to the vertical posts 58. Thus, the panels are supported by frame members.

Each sidewall panel 60 has a multiplicity of round sidewall panel holes 64 that are approximately five-eights of an inch (16 mm) in diameter. These sidewall panel holes 64 provide the auto rack car 40 with natural light as well as ventilation. These holes allow toxic vehicle fumes generated by the vehicles during loading or unloading the vehicles into or out of the auto rack car to be vented to the outside of the car, thereby protecting the persons driving the vehicles.

The auto rack car 40 illustrated in FIG. 2 is a tri-level car having first, second, and third compartment levels 66, 68, and 70, respectively. The first level 66 includes a floor or deck 72 and the second and third levels 68 and 70 include decks 74 and 76, respectively, on which the vehicles (not shown) are supported. Normally, eighteen passenger vehicles can be transported in a tri-level auto rack car, six on each level. Auto rack cars are also manufactured as bi-level cars which differ from the tri-level car in that they include two levels for vehicles instead of three levels. The bi-level auto rack car is generally used to transport larger vehicles such as vans, mini-vans, pick-up trucks, and sport utility vehicles or four-by-fours. The bi-level auto rack cars can usually transport twelve of these vehicles, six on each level.

In both the tri-level and bi-level cars, each sidewall panel 60 is individually attached by brackets 62 to the vertical posts 58 at each corner of the sidewall panel 50 such that horizontally extending gaps 80 exist between adjacent sidewall panels. These sidewall panel gaps 80 generally vary in size from about one and three-eighths inches to two and a half inches (35 to 51 mm). Floor gaps 82 also exist between the lowermost sidewall panel and the floor, as illustrated in FIG. 2. The floor gaps 82 range from about one-half inch to two and one-half inches (12.7 to 63.5 mm). Other gaps at the floor of the auto rack car may also exist, as discussed below. Roof gaps 84 also exist between the uppermost sidewall panel and the roof. The roof gaps 84 range from about one-half inch to two and a half inches (12.7 to 63.5 mm). Although not shown, vertically extending gaps also exist between the sidewall panels and the vertical posts. The vertically extending gaps range from approximately one-half inch to one inch (12.7 to 25.4 mm). The size of these gaps depend on the original construction, movement, and thermal expansion of the auto rack cars.

The auto rack cars are constructed with these gaps for several reasons. The sidewall panels and the vertical posts are galvanized steel and tend to expand as the temperature increases and contract as the temperature decreases. The construction of the sidewall panels allows for this thermal expansion and contraction. Furthermore, the auto rack car is constantly shimmying, swaying, twisting, and rocking when in transit. The construction of the vertical posts and the attachment of the sidewall panels allow for this movement without structural damage to the entire car. To date, there are approximately 40,000 auto rack cars constructed in this manner.

To reduce the entry of these contaminates into the auto rack car through these gaps, the velocity of the air flow into and throughout the auto rack car from the air gaps must be reduced. If the air flow inside of the auto rack car is reduced to below a threshold level, the entry of such contaminates will be significantly reduced and the finishes of the newly manufactured vehicles will be preserved.

Figure 10:
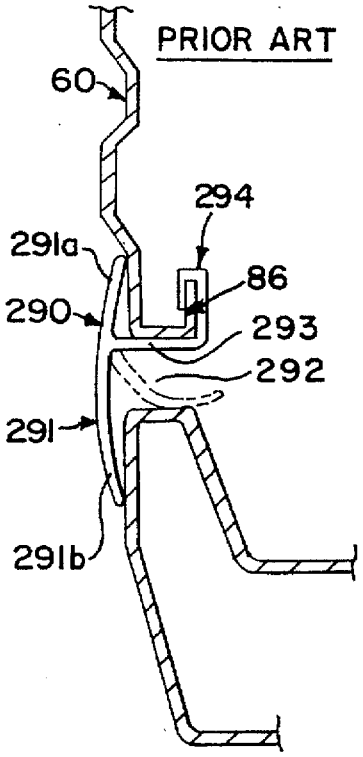
FIG. 10 is a cross-sectional view of a prior art gap closing device.

It has been known to provide a gap closing device like that in FIG. 10 which is extruded from plastic and can be installed from the outside of the car. However, this device cannot be effectively locked in place without the assistance of an installer on the inside of the car. Further, it only functions with channel flanged sidewall panels. It has also been known to provide gap closing devices as shown in U.S. Pat. Nos. 5,239,933; 5,311,823, and 5,415,108. However, these devices do not completely solve the problem due to the large variety of flange panels, plates, and splash pans.

One embodiment of the gap closing device of the present invention, generally indicated by numeral 100 as illustrated in FIG. 3, includes an elongated strip of flexible extruded plastic having locking and pressure fins, as explained below, which permit the device to be installed from the outside of the car, and which is self-locking in the installed position.

The gap closing device 100 is preferably made or extruded from a somewhat rigid polyvinyl chloride (PVC), having a durometer hardness of about 80 on the D scale, or may alternatively be made of other suitable flexible materials such as low-density polyethylene, rubber, or urethane. The plastic from which the gap closing device of the present invention is made may also include a conventional UV inhibitor.

The gap closing device 100 has an elongated horizontally disposed spine 102 having inner and outer ends 104 and 106 and top and bottom sides or surfaces 108 and 110, respectively. The gap closing device 100 further includes an arcuate closing flap 112 centrally attached to the outer end 106 of the spine 102. The closing flap 112 has upper and lower wing sections 114 and 116 which are adapted to engage the outer surfaces of the sidewall panel and the floor and is suitably sized to span and close the floor gap between the floor and the adjacent panel to prevent high velocity air from entering the car through the gap.

The gap closing device 100 further includes at least one and preferably a plurality of spaced-apart somewhat flexible locking fins 118 extending upwardly from the top side or surface 108 of the spine 102. Each locking fin 118 extends upwardly and toward the flap 112 at an approximately 45 degree angle, and has a free end opposite the end connected to or integrally formed with the spine. Any suitable angle may be provided for the disposition of the locking fins such that they preferably work against outward movement of the device. One or more of the free ends of the locking fins are adapted to engage the flange of the sidewall panel as discussed below.

The gap closing device 100 includes at least one substantially resilient pressure fin 120 attached to and extending downwardly from the bottom side or surface 110 of the spine 102 opposite the locking fins 118. It will be appreciated that a plurality of pressure fins may be connected to the spine. The pressure fin 120 has a first section 122 which extends downwardly from the spine 102 at a substantially ninety degree angle and a second curved or cantilevered section 124 connected integrally to or extruded with the first section 122. The second curved section is sized and mounted to be biased against the floor and provide upward pressure on the spine, thereby locking the device in place to close the gap. Thus, the pressure fin constantly exerts upward pressure on the spine by tending to return to its naturally formed extruded position. Further, the pressure fin may be otherwise shaped so long as it functions to bias the spine upward to urge the locking fins into engagement with the panel.

Figure 4:
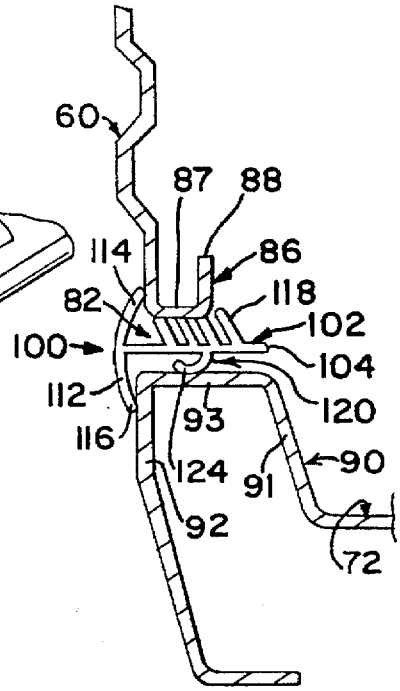
FIG. 4 is a cross-sectional view of the gap closing device mounted between a standard flange sidewall panel and the floor of the car.

Referring now to FIG. 4, the sidewall panel 60 of the auto rack car has an L-shaped flange extending around its periphery. The L-shaped flange 86 has a first leg 87 which is connected to the corrugated body or face of the sidewall panel 60 and which extends generally horizontally into the car and substantially perpendicular to the body. The flange 86 has a second leg 88 which is connected to the first leg 87 and is thus substantially parallel to the body or face of the panel 60. The second leg 88 of the flange extends upwardly. Thus, a channel is formed at the panel periphery. The floor or deck 72 of the auto rack car illustrated in FIGS. 4 to 7 has a horizontally extending ledge 90 along each side of the car. The ledge 90 has upwardly extending inside and outside walls 91 and 92, and a horizontally extending shoulder or sill 93 connected to and supported by the walls 91 and 92.

The gap closing device 100 of the present invention may be installed on the auto rack car by a person standing on the ground outside of the car. The person inserts the inner end 104 of the spine 102 into the floor gap 82 and the locking fins engage the flange 86 of the sidewall panel and the pressure fin engages the ledge 90 of the floor 72. More particularly, the free ends of the locking fins 118 engage the first leg 87 of the sidewall panel flange 86, and the second curved section 124 of the pressure fin 120 biasingly engages the top surface of the sill 93 on the ledge 90 to force the spine 102 upwardly, thereby maintaining the locking fins 118 in locking position against the flange 86. The pressure fin and the locking fins thus coact to retain the gap closing device 100 in the gap. The closing flap 112, and particularly the upper and lower wings 114 and 116 span the entire vertical height of the gap and respectively engage the outer surface of the corrugated body or face of the sidewall panel 60 and the outer surface of the outer wall 92, thereby closing the floor gap 82. The gap closing device 100 thereby prevents high-velocity air and contaminants from entering the auto rack car through the gap. As is readily appreciated, the size of the gap closing device may vary depending on the gap size and the movement of the sidewall panels and is self-locking on the car after being installed from the outside.

Figure 5:
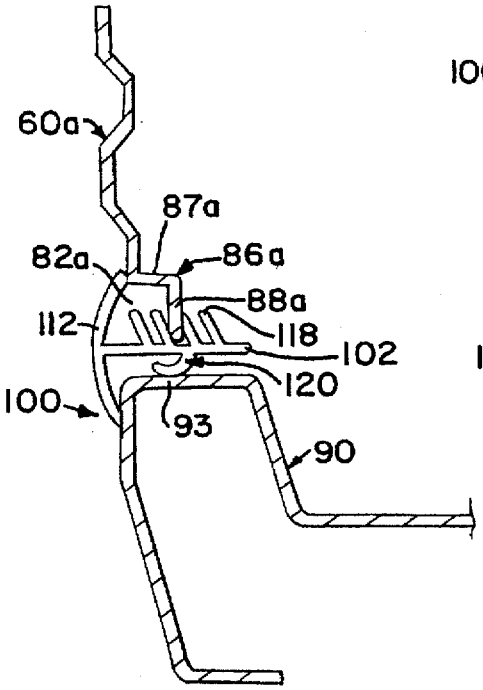
FIG. 5 is a cross-sectional view of the gap closing device mounted between a modified flange sidewall panel and the floor of the car.

Referring now to FIG. 5, an alternative construction of the auto rack car sidewall panel is shown for which the gap closing device 100 of the invention may be used. The sidewall panel 60*a* includes an L-shaped flange 86*a*, a first horizontal leg 87*a* connected to and extending substantially perpendicular to the body of the sidewall panel 60*a* and a second leg 88*a* connected to and extending downwardly from the first leg 87*a* and in substantially parallel relation to the body of the panel 60*a*. When the gap closing device is installed, the spaced-apart locking fins 118 engage the leg 88*a* of the panel flange 86*a* such that the free end of the leg 88*a* normally extends between a pair of adjacent locking fins, and the pressure fin 120 biasingly engages the sill 93 to force the spine 102 upward to drive the locking fins 118 in locking position with the panel flange. The closing flap 112 spans the gap 82*a*, thereby closing the floor gap 82*a* and preventing high-velocity air and contaminants from entering the auto rack car through the gap.

Figure 6:
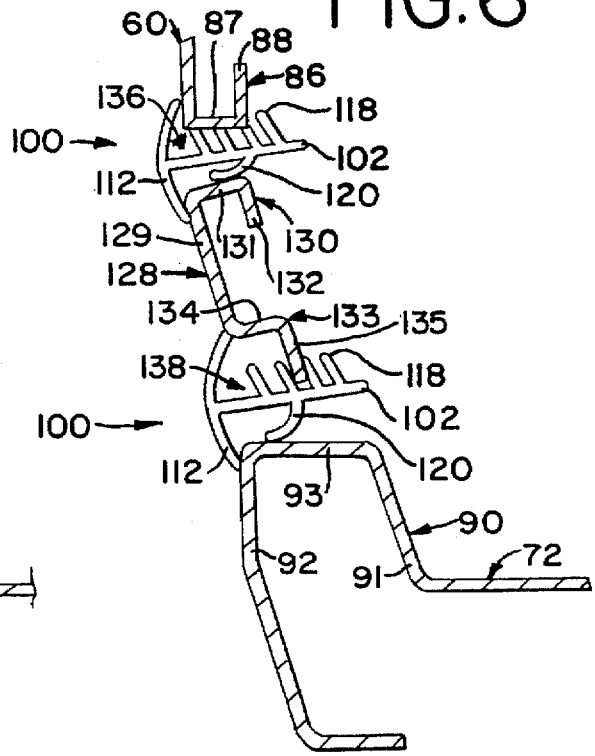
FIG. 6 is a cross-sectional view of the gap closing device mounted between a standard flange sidewall panel and an auxiliary floor panel, and between the modified flange auxiliary floor panel and the floor of the car.

Referring now to FIG. 6, a further alternative construction of the auto rack car is illustrated for which the gap closing device 100 of the invention may be used. Similar to FIG. 4, this car includes a sidewall panel 60 having an L-shaped flange 86 with first and second legs 87 and 88, respectively. The car also has a floor 72 similar to that shown in FIG. 4 having a ledge 90 with inside and outside walls 91 and 92 supporting a sill 93. However, because of a much larger gap between the panel and the floor, an auxiliary floor panel 128 is mounted between the sidewall panel 60 and the floor 72. The auxiliary sidewall panel 128 includes a face wall or body 129, an upper L-shaped flange 130 and a lower L-shaped flange 133. The upper L-shaped flange 130 has a first leg 131 which is connected to the body of auxiliary panel 128 and which extends into the car substantially perpendicular to that body. A second leg 132 is connected to the first leg 131 and extends downwardly substantially parallel to the body or face of the auxiliary panel 128. The lower L-shaped flange 133 has a first leg 134 which is connected to the body of auxiliary panel 128 and which extends into the car substantially perpendicular to that body. A second leg 135 is connected to the first leg 133 and extends downwardly substantially parallel to the body or face of the auxiliary panel 128. An upper auxiliary air gap 136 is defined between the sidewall panel flange 86 and the upper flange 130 and a lower auxiliary air gap 138 is defined between the lower flange 133 and the floor 72. The auxiliary panel 128 is generally tilted or angled inwardly between the sidewall panel 60 and the ledge 90.

The gap closing devices 100 are mounted in the upper and lower auxiliary air gaps 136 and 138. In the upper air gap 136, the locking fins 118 engage the flange 86 of the sidewall panel and the pressure fin 120 biasingly engages the flange 130 of the auxiliary panel 128 forcing the spine 102 upward which maintains the locking fins 118 in locking position against the first leg 87 of the flange 86. The closing flap 112 spans the entire vertical height of the upper auxiliary air gap 136, thereby closing the gap. It should be appreciated that a gap closing device with a plurality of pressure fins may be used to insure engagement with the relatively narrow first leg 131 of the flange 130. In the lower air gap 138, the locking fins 118 engage the flange 133 of the sidewall and the pressure fin 120 biasingly engages the ledge 90 of the floor 72 forcing the spine 102 upward to maintain the locking fins 118 in locking position on the second leg 135 of the flange 133, similar to FIG. 5. The closing flap 112 spans the entire vertical height of the gap 138, thereby closing the lower auxiliary gap 138.

As generally illustrated in FIG. 2, it should be appreciated that the gap closing device 100 of the present invention could be used to close the gaps between adjacent sidewall panels, between the sidewall panels and the vertical posts, and between the sidewall panels and the roof. The gap closing device may be installed from the inside or outside of the auto rack car, as illustrated in FIG. 2.

Figure 7:
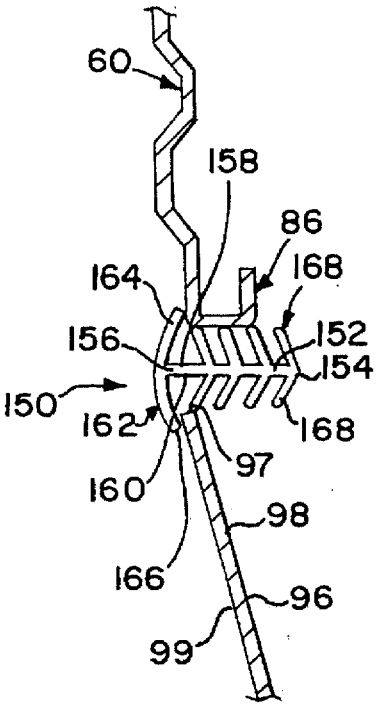
FIG. 7 is a cross-sectional view of a further embodiment of the gap closing device of the present invention mounted between a standard flange sidewall panel and an auxiliary floor plate attached to the floor of the car.

Referring now to FIG. 7, a modified gap closing device of the invention, generally indicated by numeral 150, is shown mounted on a still further alternative car construction between the flange 86 of the sidewall panel 60 and an auxiliary plate 96 attached to and extending upwardly from the floor (not shown). The auxiliary plate 96 has a top edge 97 and inside and outside walls 98 and 99. The gap closing device 150 includes an elongated horizontally disposed spine 152 having inner and outer ends 154 and 156 and top and bottom sides or surfaces 158 and 160, respectively. The gap closing device 150 further includes an arcuate closing flap 162 centrally attached to the outer end 156 of the spine 152. The closing flap 162 has upper and lower wing sections 164 and 166 which are adapted to engage the outer surfaces of the sidewall panel and the floor and suitably sized to span and close the floor gap and thereby prevent high velocity air from entering the car through the gap.

The gap closing device 150 further includes at least one, but preferably a plurality of spaced-apart somewhat flexible locking fins 168 extending from the top and bottom sides or surfaces 158 and 160 of the spine 152. The locking fins 168 attached to the top surface 158 of the spine 152 extend upwardly from the spine 152 at an approximately 60 degree angle toward the upper wing 164 of the closing flap 162 and the locking fins 168 attached to the bottom surface 160 of the spine 152 extend downwardly from the spine 152 at an approximately 60 degree angle toward the lower wing 166 of the closing flap 162. It will be appreciated that the angle between the fins and spine may be other than about 60 degrees as long as the desired locking engagement is provided. Each locking fin 168 has a free end opposite the end attached to the spine and which is adapted to engage the flange of the sidewall panel or the auxiliary plate.

The gap closing device 150 is installed on the auto rack car preferably by a person standing on the ground outside of the car. The person inserts the inner end 154 of the spine 152 into the floor gap where the upwardly extending locking fins engage the flange 86 of the sidewall panel and the downwardly extending locking fins engage the top edge 97 and/or inner wall 98 of the auxiliary plate 96. The upper and lower locking fins coact to maintain the closing device in the gap between the flange 86 and auxiliary plate 96. The closing flap 162, and particularly the upper and lower wings 114 and 116, span the entire vertical height of the gap and respectively engage the outer surface of the body or face of the sidewall panel and the outside wall 99, thereby closing the gap. The gap closing device 150 thereby prevents high-velocity air and contaminants from entering the auto rack car through the gap.

Figure 8:
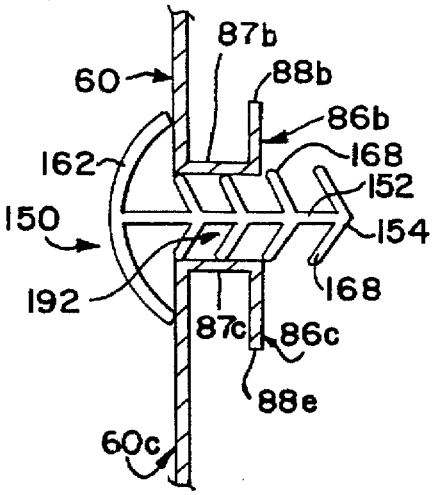
FIG. 8 is a cross-sectional view of the gap closing device of FIG. 7 mounted between adjacent sidewall panels and installed from the outside of the car.
Figure 9:
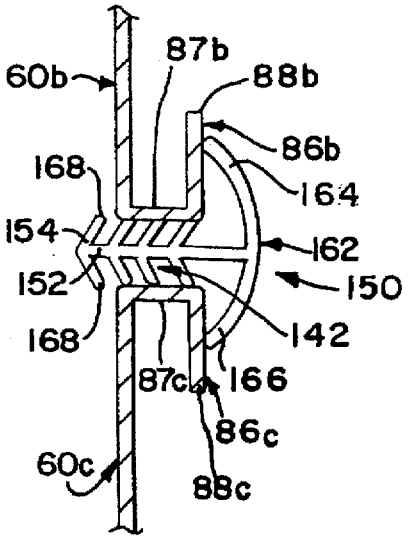
FIG. 9 is a cross-sectional view of the gap closing device of FIG. 7 mounted between adjacent sidewall panels and installed from the inside of the car.

Referring now to FIGS. 8 and 9, the gap closing device 150 is shown mounted in a gap between vertically adjacent upper and lower sidewall panels 60*b* and 60*c*. Sidewall panel 60*b* has an L-shaped flange 86*b* having a first leg 87*b* and an upwardly extending second leg 88*b*. Sidewall panel 60*c* has an L-shaped flange 86*c* having a first leg 87*c* and a downwardly extending second leg 88*c*. A horizontally extending sidewall panel gap 142 is defined between the two flanges. In FIG. 8, the gap closing device 150 is mounted in the gap 142 between sidewall panels 60*b* and 60*c* from the outside of the car by inserting the inner end 154 of the spine 152 into the gap where the upwardly extending locking fins engage the flange 86*b* of the sidewall panel 60*b* and the downwardly extending locking fins engage the flange 86*c* of the sidewall panel 60*c*. The closing flap 162 spans the sidewall panel gap, thereby closing the gap and preventing high-velocity air and contaminants from entering the car through the gap.

In FIG. 9, the gap closing device 150 is mounted in the gap between sidewall panels 60*b* and 60*c* from the inside of the car by inserting the inner end 154 of the spine 152 into the gap where the upwardly extending locking fins 168 engage the flange 86*b* of the sidewall panel 60*b* and the downwardly extending locking fins 168 engage the flange 86*c* of the sidewall panel 60*c*. The closing flap 162 spans the gap 142 on the inside of the car with the upper wing section 164 engaging the second leg 88*b* of the flange 86*b* and the lower wing section 166 engaging the second leg 88*c* of the flange 86*c*. The gap closing device 150 thereby operates to prevent high-velocity air and contaminants from entering through the gap. Thus, the device may be installed from the inside or the outside. Examples of being installed from the inside are shown in FIG. 2 at the roof area and intermediate areas from within levels 66 and 68.

A further embodiment of the invention is illustrated in FIGS. 11 to 15, wherein a gap closing device generally designated by the numeral 170 is shown to coact with cars having a splash pan and flush deck structure. This embodiment generally includes a hinged locking bar having a fin for engaging the inside surface of the splash pan. It should also be recognized that this embodiment may be used in other environments than where the car includes a flat deck and splash pan arrangement.

The particular car structure includes a splash pan 172 generally aligned with an outer edge of a deck 173. The splash pan includes a vertical wall 172*a*, a horizontal leg 172*b* extending outwardly from the upper edge of the vertical wall and an upwardly and outwardly extending inclined wall 172*c*. The deck includes an outer vertical wall 174 and a horizontal floor panel 175 where the lower edge of the splash pan 172 and the upper side of the deck defines a horizontally extending gap 177 between the splash pan and the deck. Thus, the gap closing device 170 when installed serves to close the gap 177, as illustrated in FIGS. 11, 12, 14 and 15, to prevent contaminant-laden air from entering the interior of the car.

Figure 13:
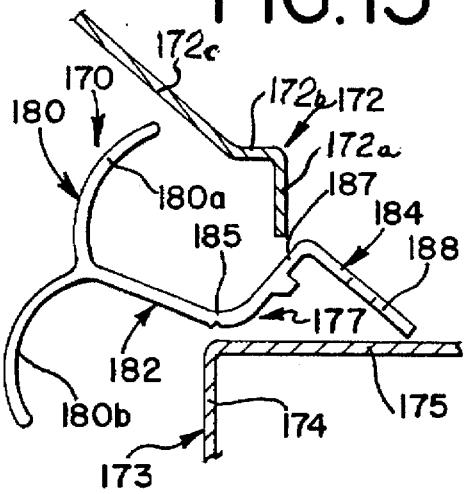
Figure 14:
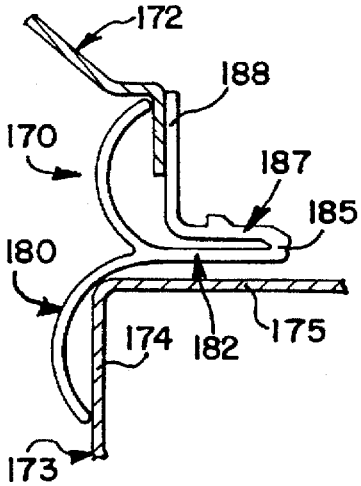
Figure 12:
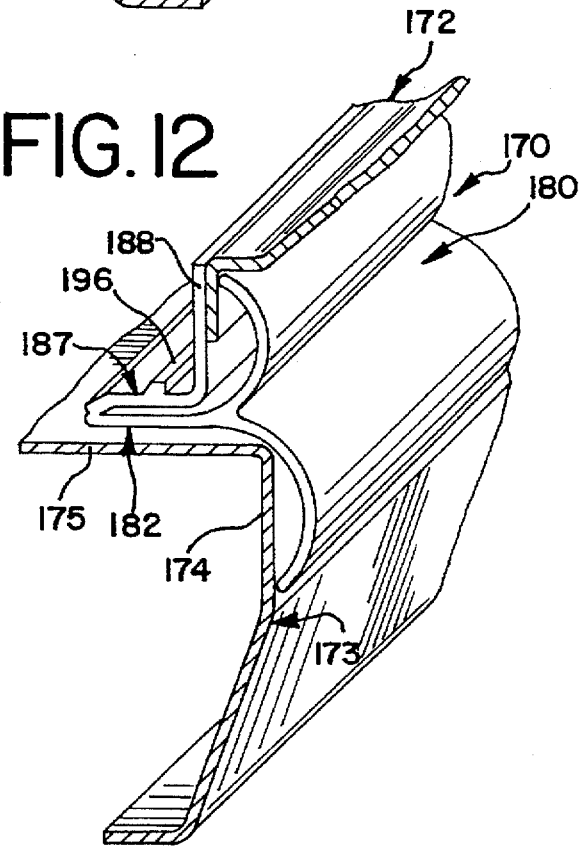
FIG. 12 is a perspective view of the outside of the wall shown in FIG. 11.

The gap closing device 170 includes a flap 180 adapted to overlap the gap 177 and close the gap when the gap closing device is installed. A spine 182 extends from the closure flap 180 and is disposed to enter into and through the gap 177. Fin means 184 is hingedly connected to the spine 182 by means of a live hinge 185 so that the fin means may be arranged in extended position during installation, as shown in FIG. 13, and thereafter folded into locked position, as shown in FIG. 14, for retaining the gap closing device in position to close the gap 177.

The fin means 184 includes a horizontal leg 187 extending from the spine and a vertical fin 188 extending substantially perpendicular to the leg. When the fin means is folded back onto the spine, as shown in FIGS. 14 and 15, the fin 188 engages the inner side of the splash pan 172 to prevent withdrawal of the gap closing device from the gap 177.

Thus, it is seen that, when the gap closing device is installed from the outside of a car, the spine and fin means arranged in open position, are inserted through the gap 177 so that the fin means can be folded against the spine into locked position so that the locking fin 188 bears against the inner side of the splash pan 172. This causes tight engagement of the closure flap 180 on the outer surfaces of the splash pan and the vertical wall 174 of the deck to prevent contaminant-laden air from entering the gap.

It will be appreciated that the flap 180 is in the form of a corrugated member by including an upper arcuate section or wing 180*a* and a lower arcuate section or wing 180*b* joined together at the spine 182. However, the flap may take other forms such as the forms shown in the previous embodiments.

Figure 11:
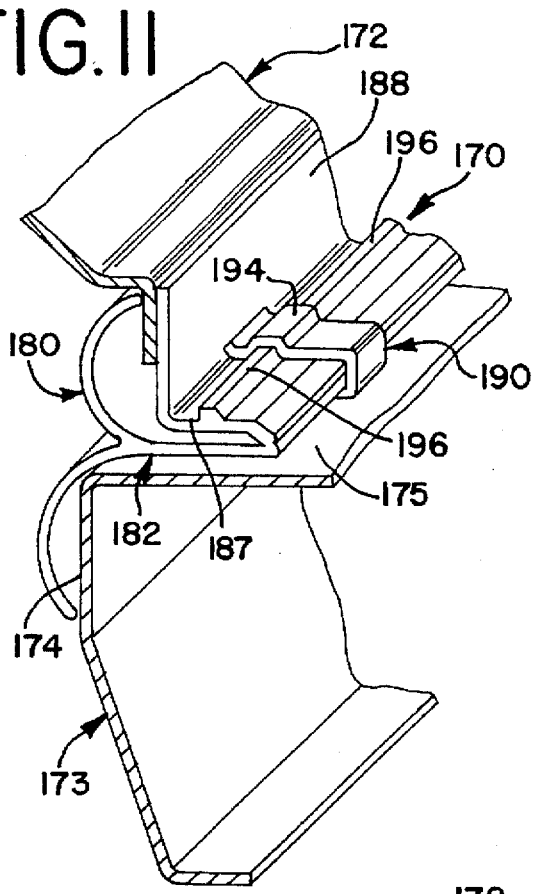
FIG. 11 is an inside perspective view of a fragmentary car wall showing a further modification of the invention.
Figure 15:
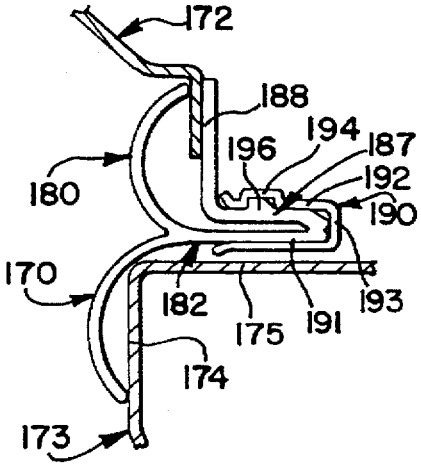

In order to lock the fin means into locking position, a U-shaped spring clip or clamp 190 is provided to overlie the hinge and the spine and leg of the fin means, as shown in FIGS. 11 and 15. This clip includes opposed legs 191 and 192 interconnected by a bight portion 193 and is preferably made of spring steel although it may be made of any suitable material capable of being flexible to be mountable and to apply the necessary forces to maintain the fin means in locked position. The leg 191 is relatively flat, while the leg 192 includes an indent 194 to coact with a detent or rib 196 on the leg 187 of the fin means. The rib 196 is formed along the entire length of the fin means leg 187 so that once the clip is installed over the leg and spine it will be locked in position by the coaction of the indent of the clip and the rib on the fin means leg. The outer free ends of the clip legs 191 and 192 are formed in diverging position in order to facilitate the application of the clip to place it in locking position. Moveover, the rib 196 includes an inclined face at the hinge side to facilitate the installation of the clip 190 and allow the legs to spread apart easily as the clip is installed. Thereafter, when the clip indent 194 aligns with the rib 196, the legs come back together under spring tension into locking position, as shown in FIG. 15. It will be further appreciated that a plurality of clips will be used along a length of the gap closing device as indicated to be necessary to maintain the fin means in locked position.

Thus, the embodiment of FIGS. 11 to 15 can be easily installed and then locked in place utilizing a person at the outside of the car to insert the locking fin and spine through the gap, and a person at the inside to fold over the locking fin means and apply clips to lock the gap closing device to the side wall of the car and close the gap. While the closing device 170 is shown for closing a horizontal gap, it may be used to close a vertical gap if desired.

The gap closing device 170 of the invention is particularly advantageous over the prior art gap closing device of FIG. 10 because the present invention can be installed after the car has been built, and therefore can be installed in prior built and used cars to close gaps. The device of FIG. 10, however, can only be installed during the building of a car. This prior art device is generally designated by the numeral 290 and includes a flap 291 overlapping the gap 292. The flap includes an upper portion 291*a* and a lower portion 291*b*. A spine 293 extends from the flap inwardly through the gap 292, and has a flange engaging locking member 294 hooking onto the sidewall flange 86. This prior art gap closing device must be installed on the sidewall panel 60 during the building of the car or the rebuilding of a car when the sidewall panels are removed for refinishing and prior to reinstallation of the panels, particularly because of the configuration of the locking member. It cannot be installed on existing cars. It can also be installed for horizontal gaps, as shown in solid lines, and where the flap portion 291*b* is disposed to engage an outside surface of the car, or for vertical gaps when the flap portion 291*b* is turned inward, as shown in phantom, to bear against the frame member opposite the sidewall panel.

Figure 16:
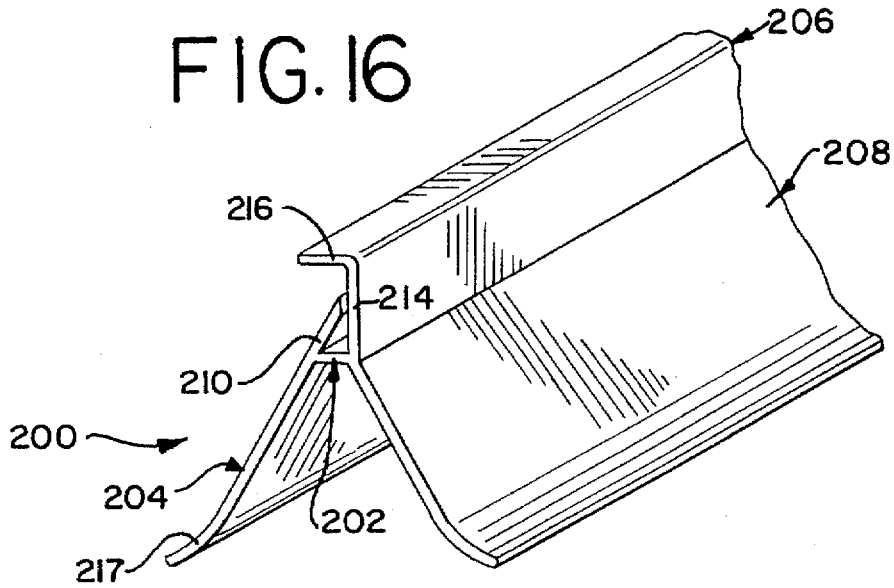
FIG. 16 is a fragmentary perspective view of a further embodiment of the gap closing device of the present invention.
Figure 17:
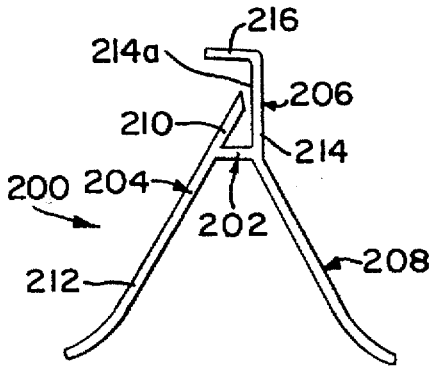
FIG. 17 is an end view of the gap closing device of FIG. 16.
Figure 18:
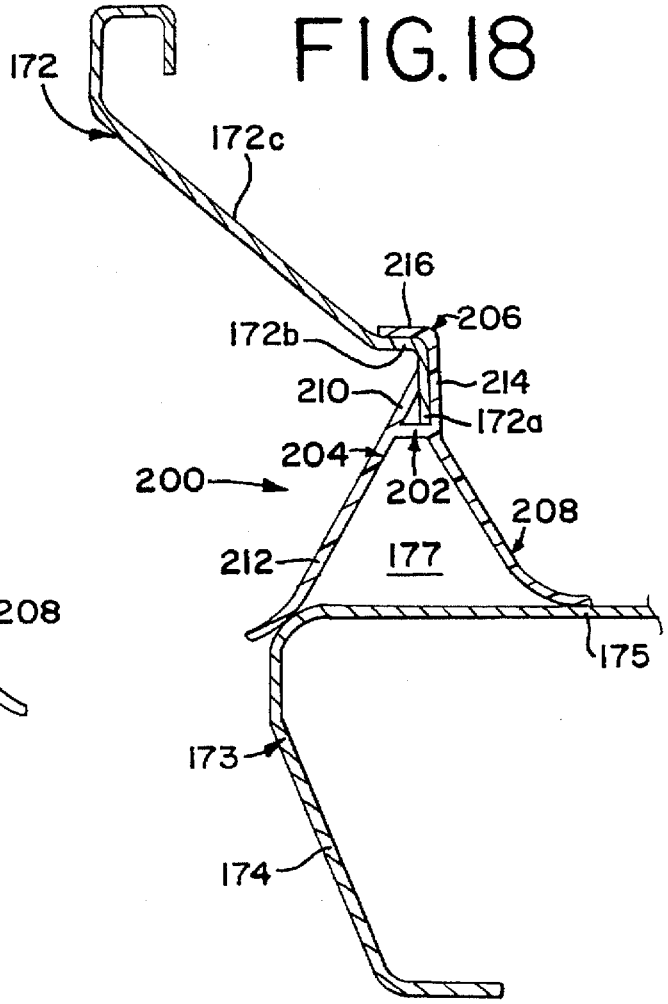
FIG. 18 is a cross-sectional view of the gap closing device of FIG. 16 mounted on a splash pan adjacent the deck.

A still further embodiment of the present invention is illustrated in FIGS. 16 to 18, wherein the gap closing device, generally designated by the numeral 200, is shown to coact with auto rack cars having a splash pan 172 and a flush deck 173 as described with the embodiment of FIGS. 11 to 15. The device 200 generally includes a locking fin for engaging the inside surface of the splash pan, a pressure fin for engaging the deck, and a closure flap for engaging the outside surface of the splash pan and deck. The gap closing device 200 when installed serves to close the gap 177 between the splash pan and the floor to prevent contaminant-laden air from entering the interior of the car.

More particularly, the gap closing device 200 includes a spine 202 disposed in and extending through the gap, a closure flap 204 connected to the spine and closing the gap when the gap closing device is installed, a locking fin 206 connected to the spine and extending upwardly against the splash pan, and a resilient pressure fin 208 connected to the spine and extending downwardly against the deck. The closure flap 204 includes an upper wing 210 having a beveled edge engaging the outer surface of the vertical leg 172*a* of the splash pan, and a lower wing 212 engaging the deck. The locking fin 206 includes a vertical section 214 extending upwardly from the spine 202 and a horizontal section 216 connected to and extending substantially perpendicular to the vertical section. When installed, the vertical section 214 engages the inside surface of the vertically disposed wall 172*a* of the splash pan and the horizontal section 216 engages the inside surface of the horizontally disposed leg 172*b* of the splash pan, as illustrated in FIG. 18.

The pressure fin 206 biasingly engages the top surface of the floor panel 175 to force the spine 202 upwardly, thereby maintaining the locking fin 206 and the upper wing 210 of the closure flap in connected relation to the splash pan. The pressure fin 208, as well as the closure flap 20, prevents air from entering the interior of the auto rack car. It will be appreciated that the closing device is formed so that the lower wing of the closure flap biases against the deck while the upper wing biases against the outer side of the splash panel.

The upper wing 210 extends upwardly from the spine 202 toward the outside surface of the splash pan 172 at an approximately 60-degree angle. While the lower wing is shown to engage the corner of the deck, it may engage any part of the deck in sealing relation depending on the relationship of the splash pan and deck which may vary due to manufacturing tolerances and wear.

It should be appreciated that the gap closing device 200 is preferably placed on the splash pan 172 by sliding the gap closing devices on the splash pan from one end of the splash pan prior to attaching the splash pan to the car.

It will be understood that modifications and variations may be effected without departing from the scope of the novel concepts of the present invention, but it is understood that this application is to be limited only by the scope of the appended claims.

What is claimed is:

1. A self-locking flexible gap sealing device for closing an air gap in a side wall of an auto rack car, said side wall having a flange and a car structure spaced from said flange which define said air gap, said flange and said car structure having outer surfaces, and said flange having an inner surface, said gap sealing device comprising:

a closure flap for overlapping the air gap and engaging the outer surfaces of the flange and the car structure, a spine extending from the closure flap and into the air gap, means extending from the spine and foldable back against the spine and for engaging said inner surface of said flange, and clip means for locking said engaging means into folding relation with said spine and for maintaining said engaging means in locking engagement with said inner surface of said flange, said engaging means and said clip means coacting to retain the closure flap in substantial sealing relation with the outer surfaces of the flange and the car structure, whereby contaminant-laden high velocity air is prevented from entering the air gap thereby protecting the finish on vehicles transported by the auto rack car.

2. The gap sealing device of claim 1, wherein the engaging means is rotatable about a live hinge connected to the spine between an unfolded position for inserting the gap sealing device into the air gap from the outside of the auto rack car and a folded position for biasingly engaging the inner surface of the flange.

3. The gap sealing device of claim 2, wherein the engaging means includes a first member hingedly connected to the spine and a second member rigidly connected to the first member, and whereby in folded position the first member extends substantially parallel to the spine and the second member engages the inner surface of said flange.

4. The gap sealing device of claim 3, wherein the first member includes a detent means for mating with an indent means on said clip means, whereby said detent means and said indent means coact to lock the clip means onto the first member and the spine.

5. The gap sealing device of claim 1, wherein the closure flap includes upper and lower sections suitably sized to span and close said air gap.

6. The gap sealing device of claim 5, wherein one of the upper and lower sections is substantially longer than the other section.

7. The gap sealing device of claim 1, wherein the clip means includes a U-Shaped metal spring clip.

8. A flexible gap sealing device for closing an air gap in a side wall of an auto rack car transporting vehicles to prevent contaminant-laden air from entering the auto rack car, said air gap defined by a sidewall panel and a car structure member spaced from said sidewall panel, said sidewall panel and said car structure member having outer surfaces, and each said sidewall panel having an inner surface, said gap sealing device comprising:

a closure flap for overlapping the air gap and engaging the outer surfaces of the sidewall panel and the car structure member which define the air gap, a spine extending from the closure flap and into the air gap, fin means extending from the spine for lockingly engaging said sidewall panel to retain the device in gap closing position, said fin means including a locking fin hinged to said spine and foldable back along the spine and against the inner surface of the side wall panel to lock the device in place, and clip means for locking said fin means into folded relation with said spine and for maintaining said fin means in locking engagement with said inner surface of said sidewall panel.

9. The flexible gap sealing device of claim 8, wherein the locking fin includes a horizontal leg connected to the spine by a live hinge and a vertical fin extending substantially perpendicularly from the horizontal leg, and whereby the horizontal leg extends along the spine and the vertical fin bears against the inner surface of said sidewall panel.

10. A gap sealing device for closing an air gap in a side wall of an auto rack car to prevent contaminant-laden air from entering the auto rack car through the air gap, said air gap being defined between a splash pan and a deck, said splash pan and deck having outer surfaces, and said splash pan having an inner surface, said gap sealing device comprising:

a closure flap for overlapping the air gap and engaging the outer surfaces of the splash pan and the deck, a spine extending from the closure flap and into the air gap, fin means extending from the spine for lockingly engaging said splash pan to retain the device in the air gap, said fin means including a first member hinged to said spine and foldable back along the spine and a second member attached to the first member for engaging the inner surface of the splash pan to lock the device in place, and clip means for locking said first member into folding relation with said spine and for maintaining said second member in locking engagement with said inner surface of said splash pan.

11. The gap sealing device of claim 10, wherein the fin means is connected to the spine by a live hinge to facilitate rotation of said fin means between an unfolded position for inserting the gap sealing device into the air gap from the outside of the auto rack car and a folded position for biasingly engaging the inner surface of the splash pan.

12. In an auto rack railroad car having opposed walls, a roof, and a floor, said opposed walls including a plurality of horizontally extending and vertically spaced apart sidewall panel members defining horizontally extending air gaps between the sidewall panel members and the floor, said sidewall panel members and the floor having outer surfaces, and said sidewall panel members each having an inner surface, and means for sealing one of the air gaps between the sidewall panel members and the floor, said sealing means comprising a plastic body having a closure flap means for overlapping the gap and engaging the outer surfaces of the sidewall panel member and the floor defining the air gap, spine means connected to said closure flap means for extending from said closure flap into the air gap, fin means extending from the spine means for lockingly engaging said inner surface of said sidewall panel member to retain the closure flap means in place, said fin means including a locking fin hinged to said spine and foldable back along the spine and the inner surface of the sidewall panel member, and means for securing the locking fin in folded relation to the spine means.

13. The sealing means of claim 12, wherein the securing means includes a U-shaped metal spring clip over the locking fin and the spine means.

14. In an auto rack railroad car for transporting vehicles having a floor, a roof, a plurality of vertical posts extending between the floor and roof, and a plurality of sidewall members mounted between said floor, roof, and posts, said floor, roof, posts, and sidewall members each having an outer surface, and said sidewall members each having an inner surface, said sidewall members defining a plurality of horizontally extending air gaps between the sidewall members and the floor, between adjacent sidewall members, between the sidewall members and the roof, and a plurality of vertically extending air gaps between sidewall members and the posts, and means for sealing one of the air gaps, said sealing means comprising:

a closure flap for overlapping the air gap and engaging the outer surfaces of the sidewall member and the floor, the roof, the post, or the adjacent sidewall member which define the air gap, a spine extending from the closure flap and into the air gap, means hinged to the spine for biasingly engaging said inner surface of said sidewall member to maintain said closure flap in engagement with the outer surfaces of the sidewall member and the floor, the roof, the post, or the adjacent sidewall member, and means for locking said engaging means into folding relation with said spine and for maintaining said engaging means in locking engagement with said inner surface of said sidewall member, whereby said closure flap is in substantial sealing relation with the outer surfaces of the sidewall member and the floor, the roof, the post, or the adjacent sidewall member, whereby contaminant-laden high velocity air is prevented from entering the air gap thereby protecting the finish on vehicles transported by the auto rack car.

15. The sealing means of claim 14, wherein the engaging means is connected to the spine by a live hinge to facilitate rotation of said engaging means between an unfolded position for inserting the sealing means into the air gap from the outside of the auto rack car and a folded position for biasingly engaging the inner surface of the floor, the roof, the post, or the adjacent sidewall member.

16. In an auto rack railroad car for transporting vehicles having a car structure including at least one floor, a roof, and a plurality of vertical posts extending between the floor and roof, and a plurality of sidewall members mounted between said floor, roof, and posts, said car structure and sidewall members each having an outer surface, and each said sidewall member having an inner surface, a plurality of air gaps defined between the sidewall members and the car structure and between adjacent sidewall members, and means for sealing one of the air gaps, said sealing means comprising:

a closure flap for overlapping the air gap and engaging the outer surfaces of the sidewall member and car structure or the adjacent sidewall member which define the air gap, a spine extending from the closure flap and into the air gap, means hinged to the spine for biasingly engaging said inner surface of said sidewall member to maintain said closure flap in engagement with the outer surfaces of the sidewall member and car structure or the adjacent sidewall member, and means for locking said engaging means into folding relation with said spine and for maintaining said engaging means in locking engagement with said inner surface of said sidewall member, whereby said closure flap is in substantial sealing relation with the outer surfaces of the sidewall member and the car structure or the adjacent sidewall member, whereby contaminant-laden high velocity air is prevented from entering the air gap thereby protecting the finish on vehicles transported by the auto rack car.

17. The sealing means of claim 16, wherein the engaging means is connected to the spine by a live hinge to facilitate rotation of said engaging means between an unfolded position for inserting the sealing means into the air gap from the outside of the auto rack car and a folded position for biasingly engaging the inner surface of the car structure or the adjacent sidewall member.

* * * * *